US007116321B2

(12) United States Patent
Morita

(10) Patent No.: US 7,116,321 B2
(45) Date of Patent: Oct. 3, 2006

(54) DISPLAY DRIVER, ELECTRO-OPTICAL DEVICE AND METHOD OF CONTROLLING DISPLAY DRIVER

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 511 days.

(21) Appl. No.: 10/702,511

(22) Filed: Nov. 7, 2003

(65) Prior Publication Data

US 2004/0135758 A1 Jul. 15, 2004

(30) Foreign Application Priority Data

Nov. 26, 2002 (JP) ..... 2002-342509

(51) Int. Cl.
*G09G 3/36* (2006.01)
*G09G 5/00* (2006.01)

(52) U.S. Cl. ..... 345/204; 345/87; 345/98; 345/100

(58) Field of Classification Search ..... 345/204, 345/98–100

See application file for complete search history.

(56) References Cited

U.S. PATENT DOCUMENTS

2001/0013850 A1* 8/2001 Sakaguchi et al. ..... 345/87

FOREIGN PATENT DOCUMENTS

| | | |
|---|---|---|
| CN | 1345439 A | 4/2002 |
| JP | A 04-343134 | 11/1992 |
| JP | A 05-241624 | 9/1993 |
| JP | A 06-012256 | 1/1994 |
| JP | A 8-201765 | 8/1996 |
| JP | A 08-201765 | 8/1996 |
| JP | A 2000-181408 | 6/2000 |
| JP | A 2001-222276 | 8/2001 |
| JP | A 2002-23709 | 1/2002 |
| JP | A 2002-323881 | 11/2002 |

* cited by examiner

*Primary Examiner*—Richard Hjerpe
*Assistant Examiner*—Stephen Sherman
(74) *Attorney, Agent, or Firm*—Oliff & Berridge, PLC

(57) ABSTRACT

A display driver includes: a data input terminal for inputting data in which display data and command data is time-division multiplexed within one horizontal scan period; a command identification signal input terminal for inputting a command identification signal for identifying command data; a latch which fetches command data specified by the command identification signal; a decoder which decodes command data fetched into the latch; and a control section which outputs a control signal corresponding to a decoding result of the decoder. The display driver drives the display section based on the control signal and display data included within the input data.

17 Claims, 13 Drawing Sheets

DISPLAY DRIVER, ELECTRO-OPTICAL DEVICE AND METHOD OF CONTROLLING DISPLAY DRIVER

Japanese Patent Application No. 2002-342509, filed on Nov. 26, 2002, is hereby incorporated by reference in its entirety.

BACKGROUND OF THE INVENTION

The present invention relates to a display driver, an electro-optical device, and a method of controlling a display driver.

A liquid-crystal panel (generally speaking: a display panel; more generally speaking: a electro-optical device) is used as a display section of an electronic appliance such as a mobile phone, with the intention of making the electronic appliance lighter, smaller, and more energy efficient. Such a liquid-crystal panel is controlled by a display controller that executes display control after receiving instructions from a host (CPU) that imposes control over the electronic appliance.

BRIEF SUMMARY OF THE INVENTION

One aspect of the present invention relates to a display driver for driving a display section based on display data, the display driver comprising:

a data input terminal for inputting data in which display data and command data is time-division multiplexed within one horizontal scan period;

a command identification signal input terminal for inputting a command identification signal for identifying command data;

a latch which fetches command data specified by the command identification signal;

a decoder which decodes command data fetched into the latch; and a control section which outputs a control signal corresponding to a decoding result of the decoder, wherein the display section is driven based on the control signal and display data included within the input data.

Another aspect of the present invention relates to a display driver for driving a display section based on display data, the display driver comprising:

a latch which fetches input data in synchronization with a rise of a latch pulse, the input data being formed by time-division multiplexing display data and command data within one horizontal scan period, the command data being formed of a plurality of words and the horizontal scan period being specified by the period of the latch pulse;

a decoder which decodes command data positioned at a previously determined word position within the input data fetched into the latch; and a control section which outputs a control signal corresponding to a decoding result of the decoder, wherein the display section is driven based on the control signal and display data included within the input data.

A further aspect of the present invention relates to an electro-optical device comprising:

a display panel having a plurality of data lines, a plurality of scan lines, and a plurality of pixels, each of the pixels being specified by one of the data lines and one of the scan lines; and any one of the display drivers described above which drives the data lines of the display panel.

A still further aspect of the present invention relates to an electro-optical device comprising:

a plurality of data lines;

a plurality of scan lines;

a plurality of pixels, each of the pixels being specified by one of the data lines and one of the scan lines; and any one of the display drivers described above which drives the data lines.

A yet further aspect of the present invention relates to a method of controlling a display driver for driving a display section based on display data, the method comprising:

fetching command data specified by a command identification signal for identifying command data from input data in which display data and command data is time-division multiplexed within one horizontal scan period;

decoding the fetched command data;

generating a control signal corresponding to a decoding result of the command data; and driving the display section, based on the control signal and display data included within the input data.

An even further aspect of the present invention relates to a method of controlling a display driver for driving a display section based on display data, the method comprising:

fetching input data in synchronization with a rise of a latch pulse, the input data being formed by time-division multiplexing display data and command data within one horizontal scan period, the command data being formed of a plurality of words and the horizontal scan period being specified by the period of the latch pulse;

decoding command data positioned at a previously determined word position within the fetched input data;

generating a control signal corresponding to a decoding result of the command data; and driving the display section, based on the control signal and display data included within the input data.

DETAILED DESCRIPTION OF THE EMBODIMENT

Embodiments of the present invention are described below. Note that the embodiments described below do not limit the scope of the present invention as laid out in the claims herein. In addition, the entirety of the configurations described with reference to these embodiments are not limited to being essential structural components of the present invention.

A liquid-crystal panel has a plurality of scan lines, a plurality of data lines, and a plurality of pixels. The scan lines are scanned by a scan line drive circuit. The data lines are driven by a data line drive circuit. A display controller supplies display data for the data line drive circuit and also provides timing control for the scan line drive circuit and the data line drive circuit.

When a display controller that has received instructions from a host controls a data line drive circuit (generally speaking: a display driver), one method that can be considered involves the display controller outputting control signals to control the data line drive circuit directly. However, the control details are complicated in this method, increasing the number of signal lines, which raises problems concerning signal delay due to the wiring and the guaranteeing of sufficient area for the wiring, making it impossible to design for lower power consumptions and costs.

In contrast thereto, another method that could be considered involves preparing command data corresponding to the control details for a display controller, and having the display controller set that command data in the data line drive circuit. In such a case, the data line drive circuit analyzes those the thus set command data in those details, and performs the control in accordance with the result of the analysis. Since this has the advantage of simply increasing the types of command data, even if the control details become complicated, it enables expansion. However, this method makes it necessary to provide the display controller with command data input-output functions. If a general-purpose controller is provided with functions for inputting and outputting command data, therefore, the display controller becomes more complicated, the chip dimensions increase, and problems arise concerning fabrication costs and times.

The embodiments described below make it possible to provide a display driver that can input command data even with a general-purpose controller, together with an electro-optical device provided therewith and a method of controlling a display driver.

These embodiments are described below with reference to the accompanying figures.

The description of the embodiments below are based on a TFT panel that is an active-matrix type of liquid-crystal panel, by way of example, but the present invention is not limited thereto.

1. First Embodiment

Figure 1:
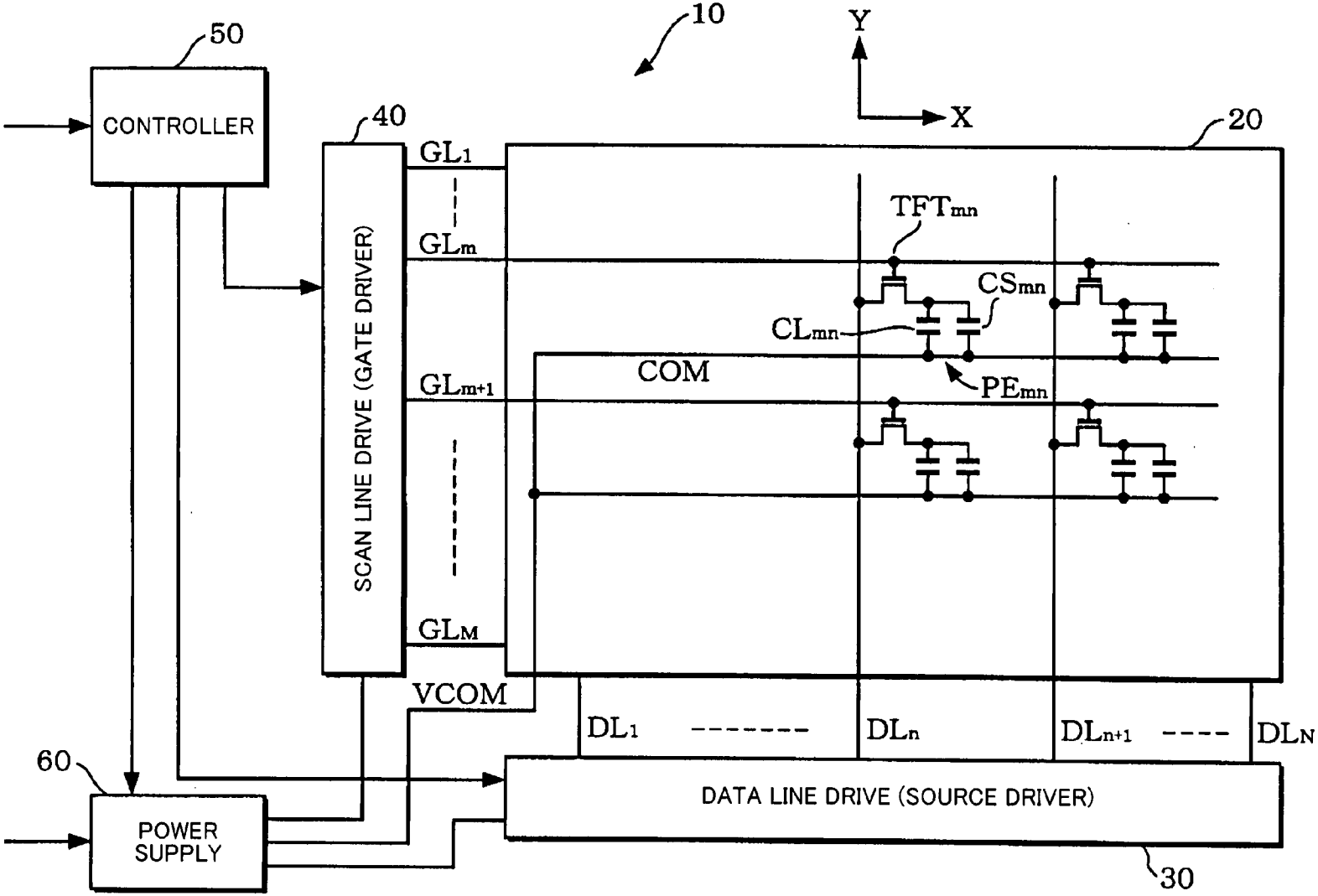
FIG. 1 is a configurational view outlining the structure of a liquid-crystal device.

An outline of the configuration of a liquid-crystal device is shown in FIG. 1. This liquid-crystal device could be incorporated in any of a variety of electronic appliances, such as a mobile phone, a portable information device. (such as a PDA), a digital camera, a projector, a portable audio player, a mass-storage device, a video camera, an electronic organizer, or a global positioning system (GPS) device.

In FIG. 1, a liquid-crystal device 10 includes a liquid-crystal panel (generally speaking: a display panel; more generally speaking: a electro-optical device) 20, a data line drive circuit (more specifically: a source driver) 30, a scan line drive circuit (more specifically: a gate driver) 40, a controller 50, and a power supply circuit 60. The liquid-crystal device 10 could be an electro-optical device. The data line drive circuit 30 could be a display driver.

Note that not all of these circuit blocks are essential for the liquid-crystal device 10; it is also possible to have a configuration without some of these components.

The liquid-crystal panel 20 includes a plurality of scan lines (gate lines), a plurality of data lines (source lines), and a plurality of pixels such that each pixel is specified by one scan line of the scan lines and one data line of the data lines. Each pixel includes a TFT and a pixel electrode. The TFT is connected to the data line and the pixel electrode is connected to that TFT.

More specifically, the liquid-crystal panel 20 is formed on a panel substrate such as a glass substrate, by way of example. Disposed on the panel substrate are scan lines $GL_1$ to $GL_M$ (where M is an integer more than one), which are disposed in the Y direction in FIG. 1 in a plurality of lines each extending in the X direction, and data lines $DL_1$ to $DL_N$ (where N is an integer more than one), which are disposed in the X direction in a plurality of lines each extending in the Y direction. A pixel $PE_{mn}$ is provided at a position corresponding to the intersection between a scan line $GL_m$ (where m is an integer such that $1 \leqq m \leqq M$) and a data line $DL_n$ (where n is an integer such that $1 \leqq n \leqq N$). The pixel $PE_{mn}$ includes a $TFT_{mn}$ and a pixel electrode.

The gate electrode of $TFT_{mn}$ is connected to the scan line $GL_m$. The source electrode of $TFT_{mn}$ is connected to the data line $DL_n$. The drain electrode of $TFT_{mn}$ is connected to the pixel electrode. A liquid-crystal capacitance $CL_{mn}$ and a subsidiary capacitance $CS_{mn}$ are generated between the pixel electrode and an opposing electrode COM (common electrode) that faces that pixel electrode with a liquid-crystal element (generally speaking: an electro-optical material) therebetween. The transmissivity of the liquid-crystal element varies in accordance with the voltage applied between the pixel electrode and the opposing electrode COM. A voltage VCOM supplied to the voltage VCOM is created by the power supply circuit 60.

The data line drive circuit 30 drives the data lines $DL_1$ to $DL_N$ of the liquid-crystal panel 20, based on display data. The scan line drive circuit 40 scans the scan lines $GL_1$ to $GL_M$ of the liquid-crystal panel 20.

The controller 50 outputs control signals for the data line drive circuit 30, the scan line drive circuit 40, and the power supply circuit 60, in accordance with details set by a host such as a central processing unit (hereinafter abbreviated to CPU) that is not shown in the figure. More specifically, the controller 50 supplies the data line drive circuit 30 and the scan line drive circuit 40 with a horizontal synchronization signal and a vertical synchronization signal that are generated based on details such as the operating mode and settings. The controller 50 also controls the polarity inversion timing of the voltage VCOM of the opposing electrode COM.

The power supply circuit 60 generates the various voltages used by the liquid-crystal panel 20 and the voltage VCOM of the opposing electrode COM, based on a reference voltage supplied from the outside.

Note that FIG. 1 shows a configuration in which the liquid-crystal device 10 includes the controller 50, but the controller 50 could equally well be provided outside of the liquid-crystal device 10. Alternatively, the configuration could be such that both the controller 50 and the host (not shown in the figure) are included within the liquid-crystal device 10.

At least one of the scan line drive circuit 40, the controller 50, and the power supply circuit 60 could be incorporated into the data line drive circuit 30.

Similarly, some or all of the data line drive circuit 30, the scan line drive circuit 40, the controller 50, and the power supply circuit 60 could be formed on the liquid-crystal panel 20. For example, the liquid-crystal panel (electro-optical device) 20 could be configured to include a plurality of data lines; a plurality of scan lines; a plurality of pixels, each specified by one of the data lines and one of the scan lines; and a data line drive circuit (display driver) for driving the data lines.

Figure 2:
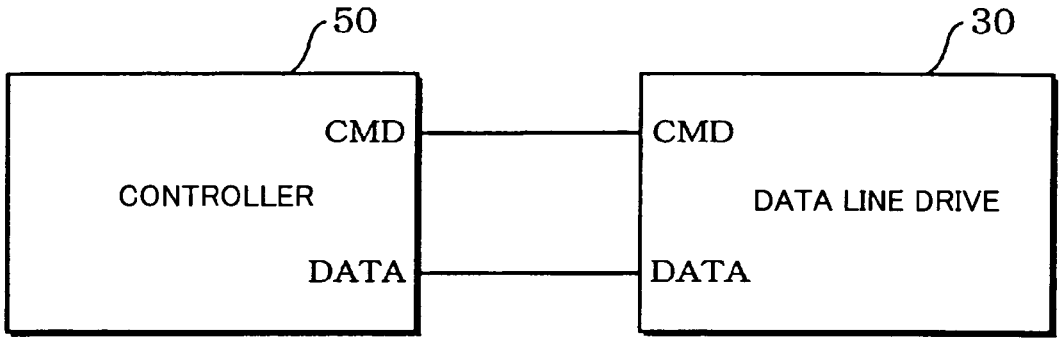
FIG. 2 is a schematic view of the connective relationship between a controller and a data line drive circuit of the first embodiment.

The connective relationship between the controller 50 in accordance with the first embodiment and the data line drive circuit 30 is shown schematically in FIG. 2. The controller 50 has a command identification signal output terminal CMD and a data output terminal DATA. The controller 50 outputs display data that includes grayscale data generated by the host, to the data line drive circuit 30 through the data output terminal DATA, in synchronization with display timing. During this time, the controller 50 also outputs data that is display data and command data time-division multiplexed within one horizontal scan period.

The controller 50 also outputs from the command identification signal output terminal CMD a command identification signal for specifying the position of command data that has been time-division multiplexed within the data that is output from the data output terminal DATA.

The data line drive circuit 30 has a command identification signal input terminal CMD and a data input terminal DATA. The data line drive circuit 30 specifies command data from data that is display data and command data which has been time-division multiplexed and input through the data input terminal DATA, based on a command identification signal that is input from the controller 50 through the command identification signal input terminal CMD. The data line drive circuit 30 ensures that the command data is decoded and performs control corresponding to the result of that decoding.

The command data is data corresponding to a command for executing a function such as setting one of the operating modes of the data line drive circuit 30. A command is a partial block selection command for partial driving, an output block selection command, or an output timing setting command, by way of example.

A partial block selection command is a command for selecting individual blocks that are units of pluralities of data lines, for driving the display of data lines by the data line drive circuit 30. A grayscale voltage corresponding to grayscale data synchronized to the display timing is applied to the data lines of a block selected for this display driving by a partial block selection command. For the data lines in blocks that are selected for non-display driving by the partial block selection command, the voltage VCOM supplied to the opposing electrode COM could be applied in such a manner that the transmissivity of the liquid-crystal elements connected to the TFTs in those data lines does not change, by way of example.

The output block selection command is a command for selecting either drive-on or drive-off by the data line drive circuit 30, for data lines in individual blocks. A grayscale voltage corresponding to the grayscale data is applied to data lines in a block that has been set to drive-on by the output block selection command, in synchronization with the display timing. The outputs to data lines in a block that has been set to drive-off by the output block selection command are set to a high impedance state.

The output timing setting command is a command for finely setting the output timings to the data lines by the data line drive circuit 30, to ensure reduced power consumptions.

The thus-configured data line drive circuit 30 specifies command data based on a command identification signal, from input data in which grayscale data and command data are time-division multiplexed, to perform control based on the thus-specified command data. It is therefore possible to perform display driver control with respect to the data line drive circuit 30 by commands from a general-purpose controller having a general purpose input/output (GPI/O) terminal that is a universal input-output terminal.

The controller need not perform control by command data. In other words, the controller could handle command data in a manner similar to that of display data, by supplying the controller with command data multiplexed in with display data (grayscale data) generated by a host. It is therefore possible to simplify the circuit of the controller for controlling the data line drive circuit 30.

The description now turns to an example of the configuration of the data line drive circuit 30 in accordance with this first embodiment.

Figure 3:
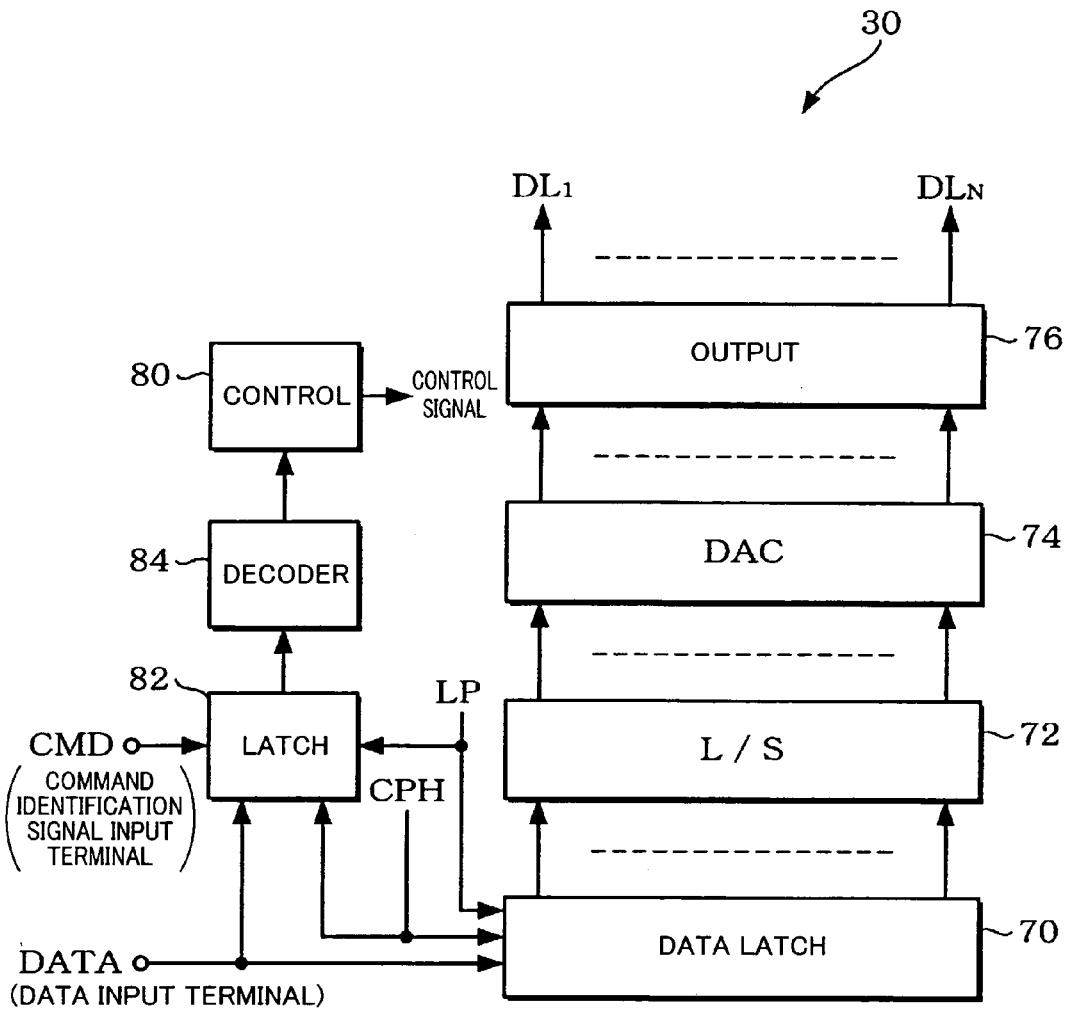
FIG. 3 is a block diagram of an example of the configuration of the data line drive circuit of the first embodiment.

An example of the configuration of the data line drive circuit 30 of the first embodiment is shown in FIG. 3. The data line drive circuit 30 includes a data latch 70, a level shifter (L/S) 72, a voltage selection circuit (digital-to-analog converter: DAC) 74, and an output circuit 76.

The data latch 70 latches the display data includes within the input data that has been input through the data input terminal DATA. The display data includes a plurality of grayscale data items in which grayscale data is divided for individual data lines. For example, the data latch 70 could includes a shift register, in which each stage of flip-flops holds one or a plurality of bits of grayscale data, and a line latch. In such a case, the display data that has been input to the initial flip-flop of the shift register is shifted and fetched by a shift clock CPH having N clocks, which is at least as many as the number of data lines, within one horizontal scan period regulated by the period of a latch pulse LP. The display data that has been fetched into the shift register in synchronization with the latch pulse LP is held in the line latch.

The L/S 72 shifts the voltage levels of outputs of the data latch 70.

The DAC 74 outputs analog grayscale voltages that corresponds to the data from the L/S 72, from among a plurality of reference voltages where each reference voltage corresponds to grayscale data. More specifically, the DAC 74 decodes the grayscale data and selects one of the reference voltages, based on the decoding result. The reference voltage selected by the DAC 74 is output to the output circuit 76 as an analog grayscale voltage.

The output circuit 76 drives the data lines $DL_1$ to $DL_N$ based on the analog grayscale voltages from the DAC 74. The output circuit 76 can also perform partial drive and output selection for individual blocks in units of a plurality of data lines. Partial drive control used the above-mentioned partial block selection command. Output selection control uses the above-mentioned output block selection command. In response to such commands, a voltage corresponding to grayscale data or the common electrode voltage VCOM (or substantially the same voltage) is applied to the data lines in each block. Alternatively, the output to the data lines in each block could be set to a high impedance state is response to a command.

The thus-configured data line drive circuit 30 is controlled based on a control signal that is output from a control section 80. This control signal could be a block selection signal for partial drive or a drive-on or drive-off block selection signal. Thus the control section 80 outputs a control signal corresponding to the command data included in the data that is input through the data input terminal DATA.

To create the above described control signal, the data line drive circuit 30 could include a latch 82 and a decoder 84. The latch 82 fetches command data from the input data, as specified by the command identification signal.

In this case, the input data is data that is display data and command data which has been time-division multiplexed within one horizontal scan period, and which is input through the data input terminal DATA. The command identification signal is a signal for identifying command data, which is input through the command identification signal input terminal CMD.

The decoder 84 decodes the command data fetched into the latch 82. The control section 80 outputs a control signal corresponding to the decoding result of the decoder 84.

Figure 4:
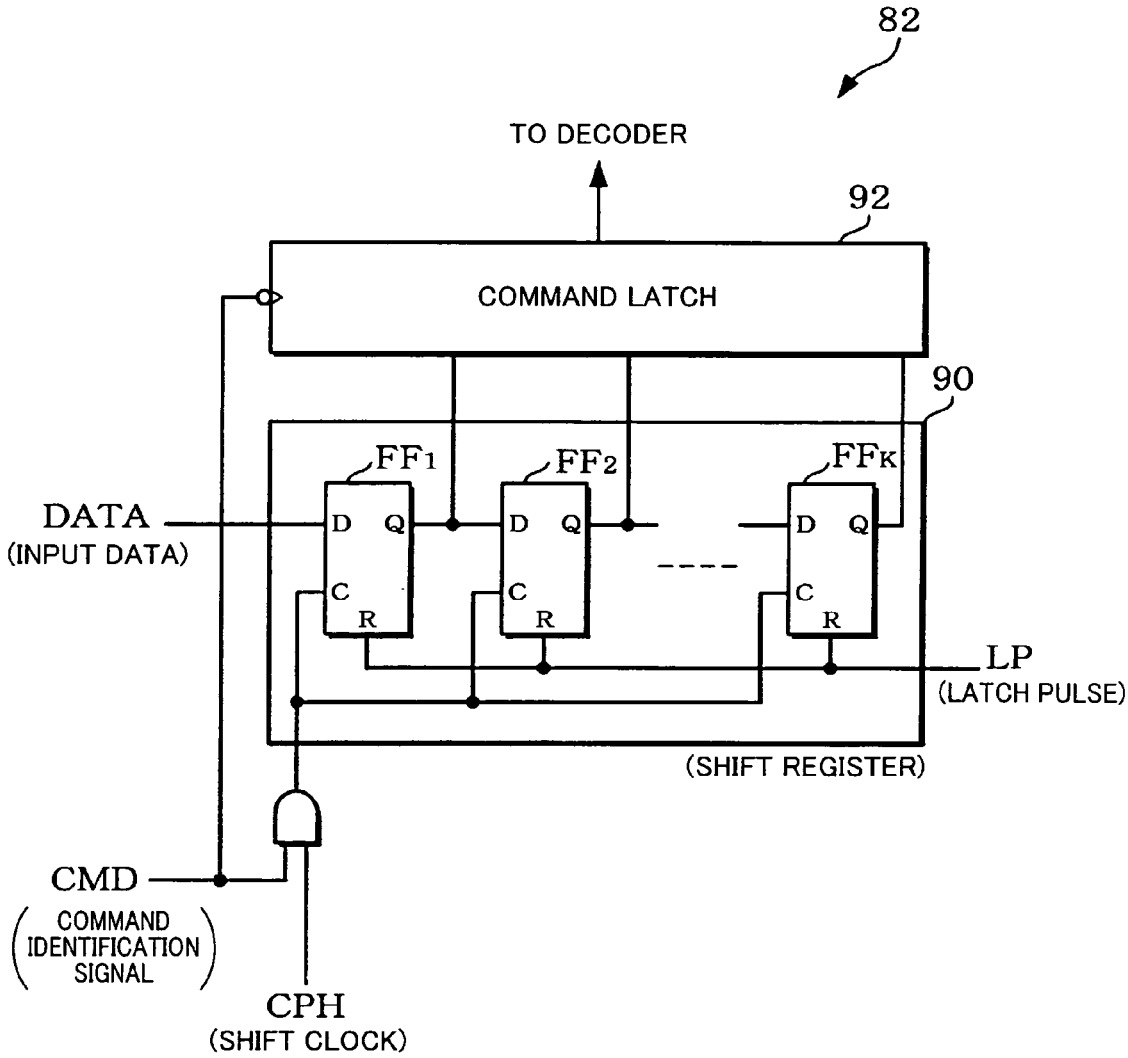
FIG. 4 is a block diagram of an example of the configuration of the latch.

An example of the configuration of the latch 82 is shown in FIG. 4. The latch 82 could include a shift register 90 and a command latch 92.

The shift register 90 has first to K-th flip-flops $FF_1$ to $FF_K$ (where K is an integer more than one). A flip-flop $FF_k$ (where k is an integer such that $1 \leqq k \leqq K$) has a clock terminal C, an input terminal D, an output terminal Q, and a reset terminal R. The flip-flop $FF_k$ holds a data signal at the input terminal D at the rise of an input signal at the clock terminal C, and outputs the thus-held data signal from the output terminal Q. The internal status of the flip-flop $FF_k$ is returned to the initial state when a signal is input to the reset terminal R.

Each flip-flop can hold one or a plurality of bits of grayscale data created in data line units. The output of the i-th flip-flop $FF_i$ (where i is an integer such that $1 \leqq i \leqq K-1$) is connected to the input of the (i+1)th flip-flop $FF_{i+1}$. Input data that has been input to the first flip-flop $FF_1$ is shifted in synchronization with a command shift clock. This command shift clock is a signal obtained by ANDing the shift clock CPH and the command identification signal.

In other words, command data is data that has been input by shifting input data in synchronization with the shift clock CPH when the logic level of the command identification signal is high. Thus, display data is data that has been input by shifting input data in synchronization with the shift clock CPH in the data latch 70 of FIG. 3 when the logic level of the command identification signal is low during the fetching of display data included in the input data.

Note that each flip-flop is reset by the latch pulse LP.

The command latch 92 latches the command data held in the first to K-th flip-flops $FF_1$ to $FF_K$, in synchronization with the fall of the command identification signal. The command data latched in the command latch 92 is output for the decoder 84.

Figure 5:
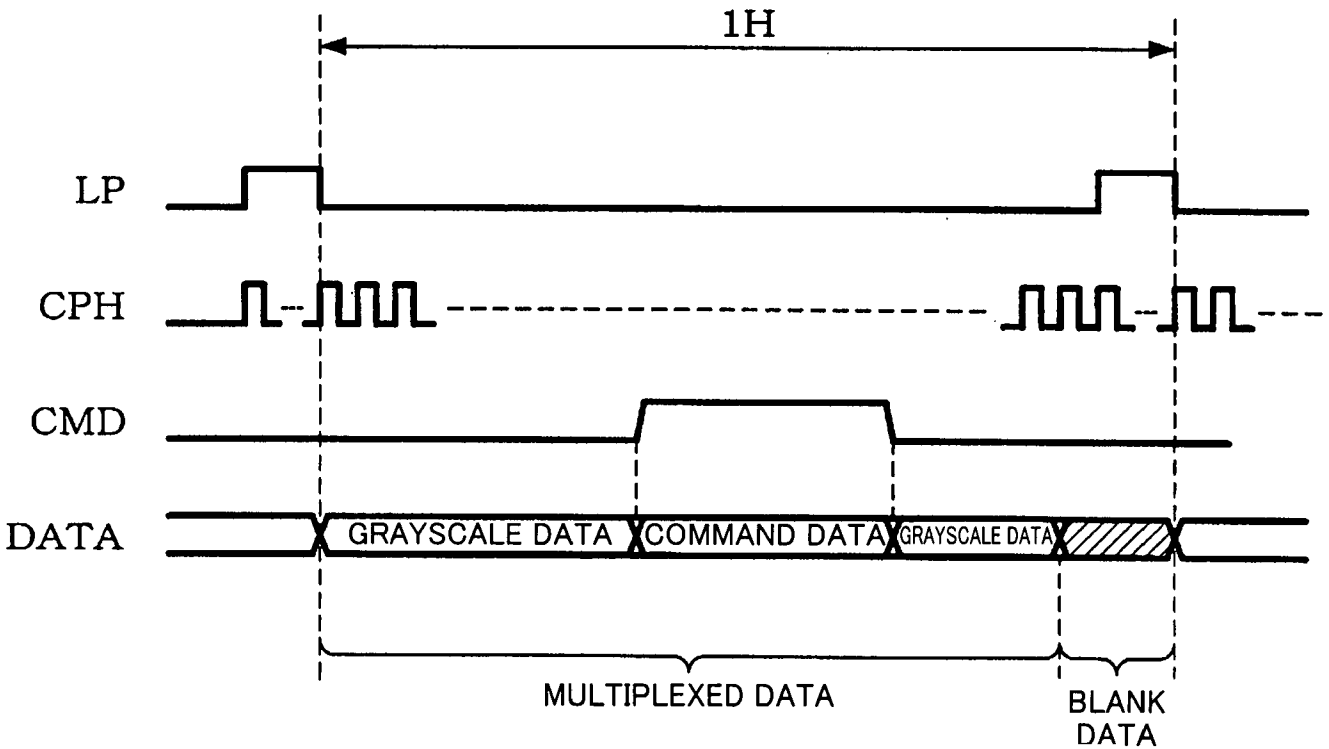
FIG. 5 is a timing chart of an example of the operation of the data line drive circuit of the first embodiment.

An example of the operational timings of the data line drive circuit 30 of the first embodiment is shown in FIG. 5. Data that is display data (grayscale data) and command data which has been time-division multiplexed within one horizontal scan is input to the data line drive circuit 30. In FIG. 5, the above-described multiplexed data and blank data is input within 1 H. The blank data is dummy data that is embedded by the controller 50 and is data that does not affect control by the display and command data.

When the logic level of the command identification signal is low, the display data in the input data is fetched into the data latch 70 of FIG. 3 and is used for display within the next horizontal scan period, by way of example.

When the logic level of the command identification signal is high, the command data in the input data is fetched into the latch 82 of FIG. 3 and is used for control within the next horizontal scan period, by way of example. In other words, the control section 80 uses the decoder 84 to decode command data in the first horizontal scan period. The control section 80 can perform control in the second horizontal scan period, which is the next horizontal scan period after the first horizontal scan period, based on the control signal corresponding to the command data decoded during the first horizontal scan period.

In this case, the decoder 84 preferably does the decoding in synchronization with a signal of a frequency higher than that of the latch pulse LP, such as the shift clock CPH. This enables the output of the decoding result within the horizontal scan period in which the command data has been fetched, making it easy to generate a control signal corresponding to that decoding result before the next horizontal scan period.

Figure 6:
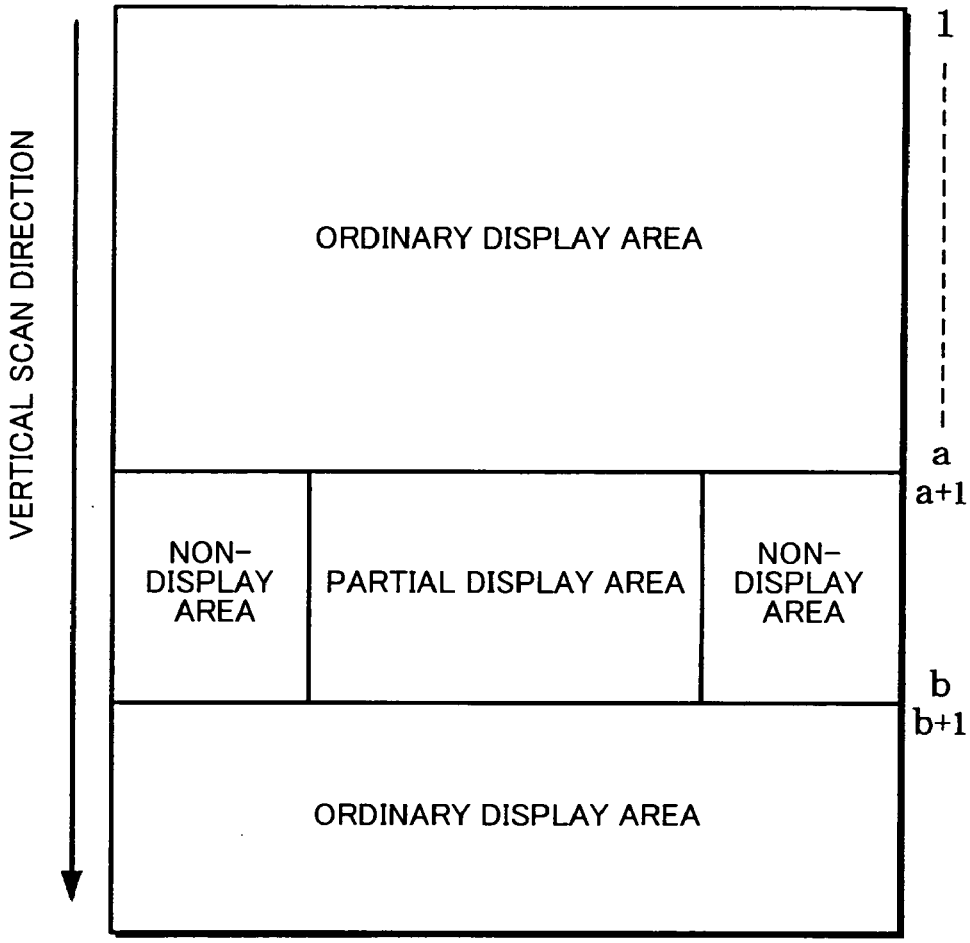
FIG. 6 is illustrative of an example of control by a partial block selection command in accordance with the first embodiment.

An illustrative view of an example of the control by a partial block selection command in accordance with the first embodiment is shown in FIG. 6. In this case, the display area of the liquid-crystal panel 20 that is scanned within one vertical scan period is shown schematically.

Assume that the scan lines selected for each horizontal scan period are scanned one-by-one in the sequence of: first line, second line, . . . first line. In FIG. 6, ordinary drive is done from the first line to the a-th line (where a is an integer). In other words, grayscale voltages corresponding to the grayscale data are applied by the data line drive circuit 30 to the data lines $DL_1$ to $DL_N$.

In this case, assume that a partial block selection command is input during the horizontal scan period for the a-th line at the timing shown in FIG. 5. In such a case, data is fetched into the latch 82 within that horizontal scan period and, as a result, it is determined to be a partial block selection command by the decoder 84. Control in the horizontal scan period for the (a+1)th line, which is the next horizontal scan period, is based on that partial block selection command. In such a case, grayscale voltages corresponding to the grayscale data synchronized to the display timing are applied to the data lines of the first block selected for the display drive. For the data lines of the second and third blocks that have been selected for non-display drive by the partial block selection command, a voltage such as the voltage VCOM supplied to the opposing electrode COM, or substantially the same voltage, is applied to ensure that there is no change in the transmissivity of the liquid-crystal elements connected to the TFTs in those data lines.

This ensures that the display area corresponding to the first block is a partial display area in which display is in accordance with the grayscale data. In contrast thereto, the display areas corresponding to the second and third blocks are partial non-display areas in which display is a background color of white or black.

If the setting is such that all blocks are subjected to display drive by the partial block selection command in the horizontal scan period for the b-th line (where b is an integer such that b>a+1), the control is such that ordinary display drive returns, starting from the horizontal scan period for the (b+1)th line, which is the next horizontal scan period.

2. Second Embodiment

A second embodiment of the present invention enables input of command data to the data line drive circuit from a general-purpose controller, without using a command identification signal.

Figure 7:
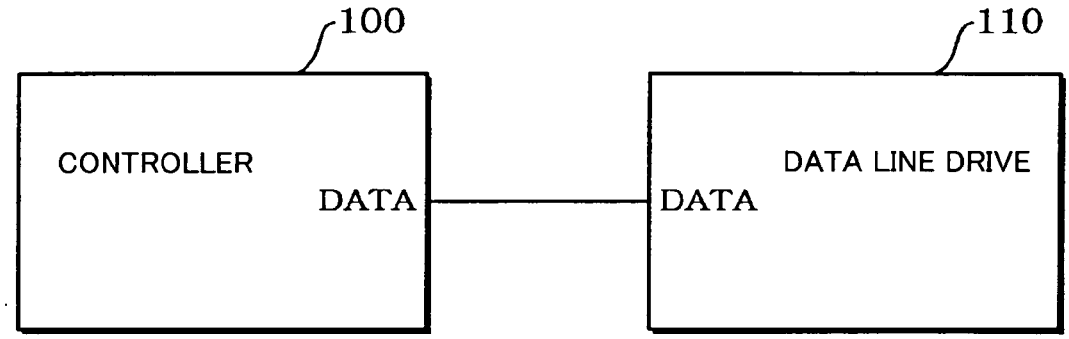
FIG. 7 is a schematic view of the connective relationship between a controller and a data line drive circuit of the second embodiment.

The connective relationship between a controller and data line drive circuit in accordance with this second embodiment is shown schematically in FIG. 7. A controller 100 can be applied to a liquid-crystal device of a similar configuration to that shown in FIG. 1, instead of the controller 50 of the first embodiment. A data line drive circuit 110 can be applied to a liquid-crystal device of a similar configuration to that shown in FIG. 1, instead of the data line drive circuit 30 of the first embodiment.

The controller 100 has the data output terminal DATA. The controller 100 outputs display data that include grayscale data created by the host, through the data output terminal DATA to the data line drive circuit 110, in synchronization with the display timing. During this time, the controller 100 outputs display data and command data that has been time-division multiplexed within one horizontal scan period. Note that the timing at which the command data is multiplexed is determined previously between the controller 100 and the data line drive circuit 110.

The controller 100 has the data input terminal DATA. Command data that has been multiplexed at a previously determined timing is specified by the data line drive circuit 110 from data that is display data and command data, which has been input through the data input terminal DATA. That command data is decoded in the data line drive circuit 110, and control corresponding to the result of that decoding is performed.

The thus-configured data line drive circuit 110 does not use a command identification signal but instead provides control based on the specification of command data from grayscale data and command data that is time-division multiplexed. It is therefore possible to provide control by command data for the controller 100 by a more general type of controller.

The description now turns to an example of the configuration of the data line drive circuit 110 in accordance with the second embodiment.

Figure 8:
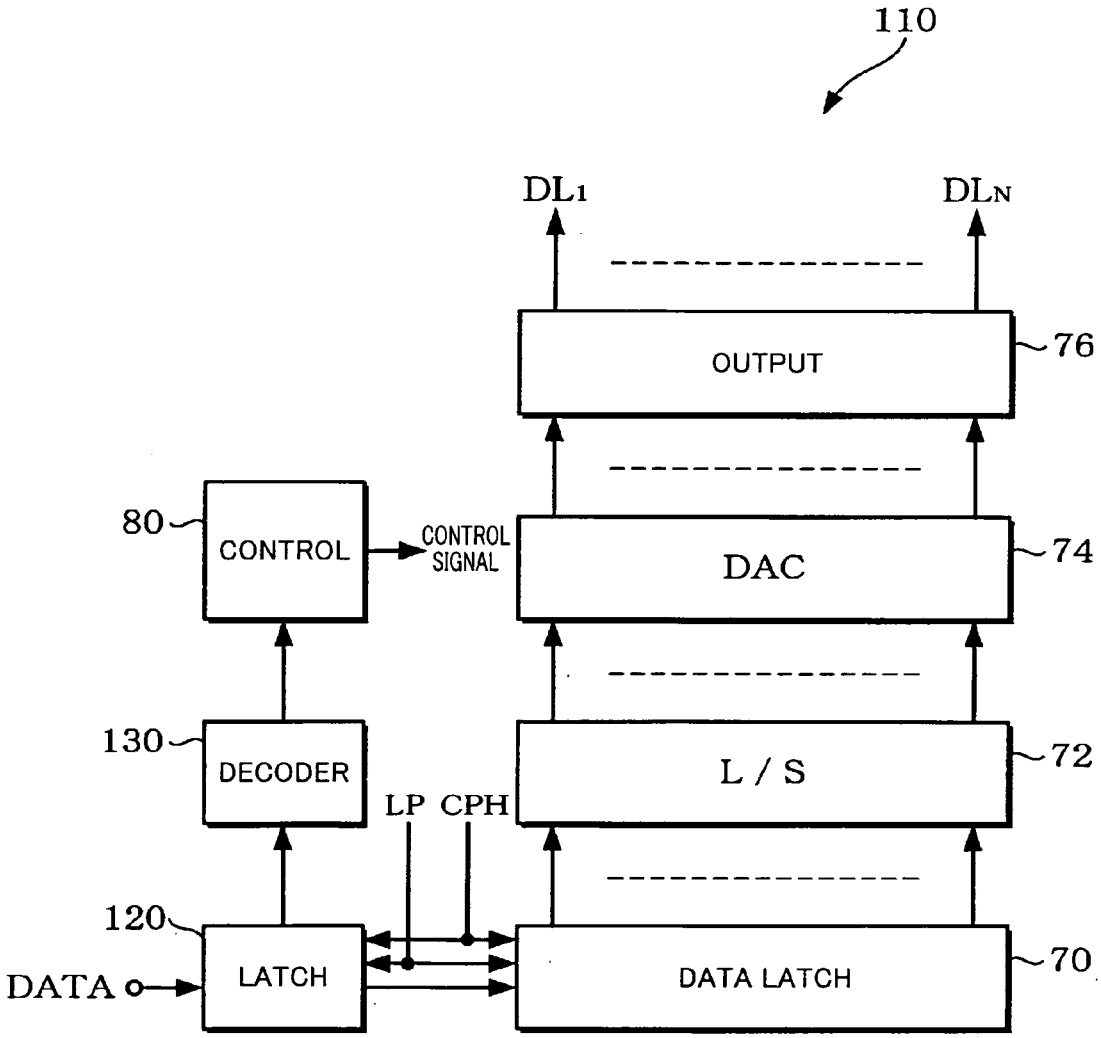
FIG. 8 is a block diagram of an example of the configuration of the data line drive circuit of the second embodiment.

This example of the configuration of the data line drive circuit 110 of the second embodiment is shown in FIG. 8. It should be noted that components that are the same as those of the data line drive circuit 30 of the first embodiment shown in FIG. 3 are denoted by the same reference numbers and further description thereof is omitted.

The data line drive circuit 110 of the second embodiment differs from the data line drive circuit 30 of the first embodiment in the configurations of the latches and decoder.

A latch 120 of the second embodiment fetches input data that is input through the data input terminal DATA, in synchronization with the rise of the latch pulse LP. The position of command data included within that input data is previously determined, so the latch 120 fetches data corresponding to that position.

A decoder 130 in accordance with the second embodiment decodes the command data that has been fetched into the latch 120. The command data of the second embodiment is differentiated into execution command data and ordinary command data. Execution command data is command data corresponding to an execution command. Normal command data is command data corresponding to an ordinary command. An execution command is a command that designates whether or not a ordinary command is to be executed. An ordinary command is a command corresponding to previously determined control details, for executing various types of control over the data line drive circuit 110. Thus, when the part of the command data that has been fetched into the latch 120 is execution command data, the data line drive circuit 110 performs control corresponding to the ordinary command data at positions other than that of that command data.

These points are described below.

Figure 9:
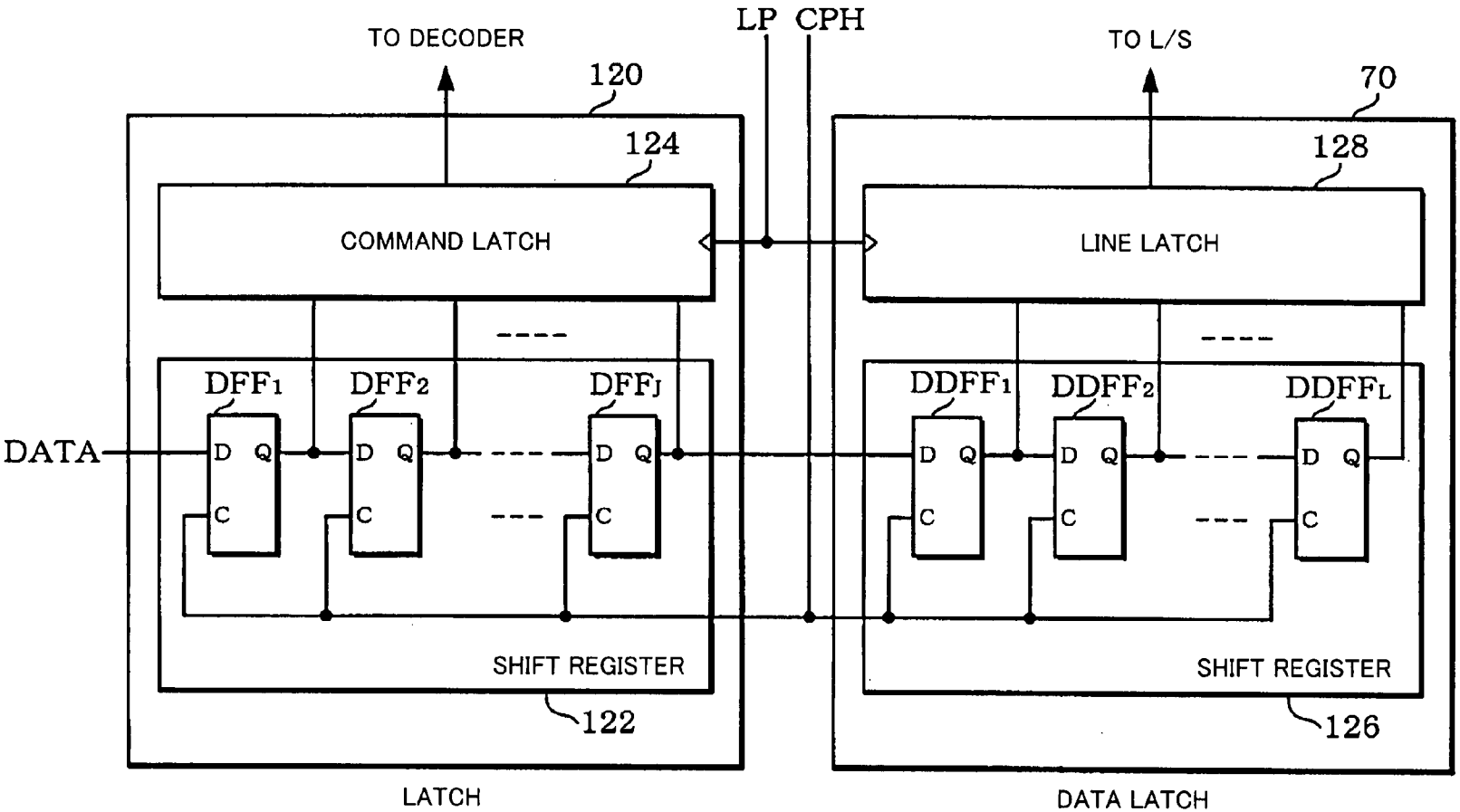
FIG. 9 is a block diagram of an example of the configuration of the latch and data latch of the second embodiment.

An example of the configuration of the data latch 70 and the latch 120 is shown in FIG. 9. The latch 120 could include a shift register 122 and a command latch 124.

The shift register 122 has first to J-th flip-flops $DFF_1$ to $DFF_J$ (where J is an integer more than one). The flip-flop $DFF_j$ (where j is an integer such that $1 \leqq j \leqq J$) has a clock terminal C, an input terminal D, and an output terminal Q. The flip-flop $DFF_L$ holds a data signal at the input terminal D at the rise of an input signal at the clock terminal C, and outputs the thus-held data signal from the output terminal Q.

The flip-flops can hold one or a plurality of bits of grayscale data that is created in data line units. The output of the j-th flip-flop $DFF_j$ is connected to the input of the (j+1)th flip-flop $DFF_{j+1}$. The input data that has been input to the first flip-flop $DFF_1$ is shifted in synchronization with the shift clock CPH.

The command latch 124 fetches the data held in the first to J-th flip-flops $DFF_1$ to $DFF_J$, in synchronization with the rise of the latch pulse LP.

The data latch 70 includes a shift register 126 and a line latch 128. The shift register 126 has first to L-th flip-flops $DDFF_1$ to $DDFF_L$ (where L is an integer more than one) flip-flops $DDFF_1$ to $DDFF_L$, in a configuration similar to that of the shift register 122. The flip-flops of the shift register 126 are in a configuration similar to that of the flip-flops of the shift register 122.

The shift output of the J-th flip-flop $DFF_J$ of the shift register 122 is input to the input of the first flip-flop $DDFF_1$ that configures the shift register 126.

The line latch 128 fetches the data that has been held in the first to L-th flip-flops $DDFF_1$ to $DDFF_L$, in synchronization with the rise of the latch pulse LP.

Input data that is input through the data input terminal DATA is input in word units, such as 16 bits per word. Grayscale data that is input in correspondence to the data lines is one word of data. The flip-flops can hold one word of data. In this case, each word of data is shift-input in synchronization with the shift clock CPH.

As described above, the configuration in which the shift register 122 of the latch 120 is connected to the shift register 126 of the data latch 70 ensures that the input data that has been held in the latch 120 of FIG. 8 can be assumed to be command data, at the point at which the shift input of the input data for one horizontal scan period has ended, by way of example.

The description of FIG. 8 assumes that the input data that is input within one horizontal scan period is L words of display data and J words of command data, multiplexed. It is therefore possible that U (where U is an integer) words of blank data could be inserted between the display data and the command data.

In such a case, the input data is assumed to include S (where S is an integer) words for each horizontal scan period, by way of example. The display data that is multiplexed in the input data is included from the first word to the N-th word of the input data. The display data at the word positions corresponds to the data lines. If it is assumed that the command data is included from the (S−T+1)th word of the input data to the final, S-th word thereof.

Since setting the final T words to be command data in this way makes it possible to simply vary the number of words from the end of the input data, even if the command set is expanded, it is possible to increase the expansibility of control by such commands.

Figure 10:
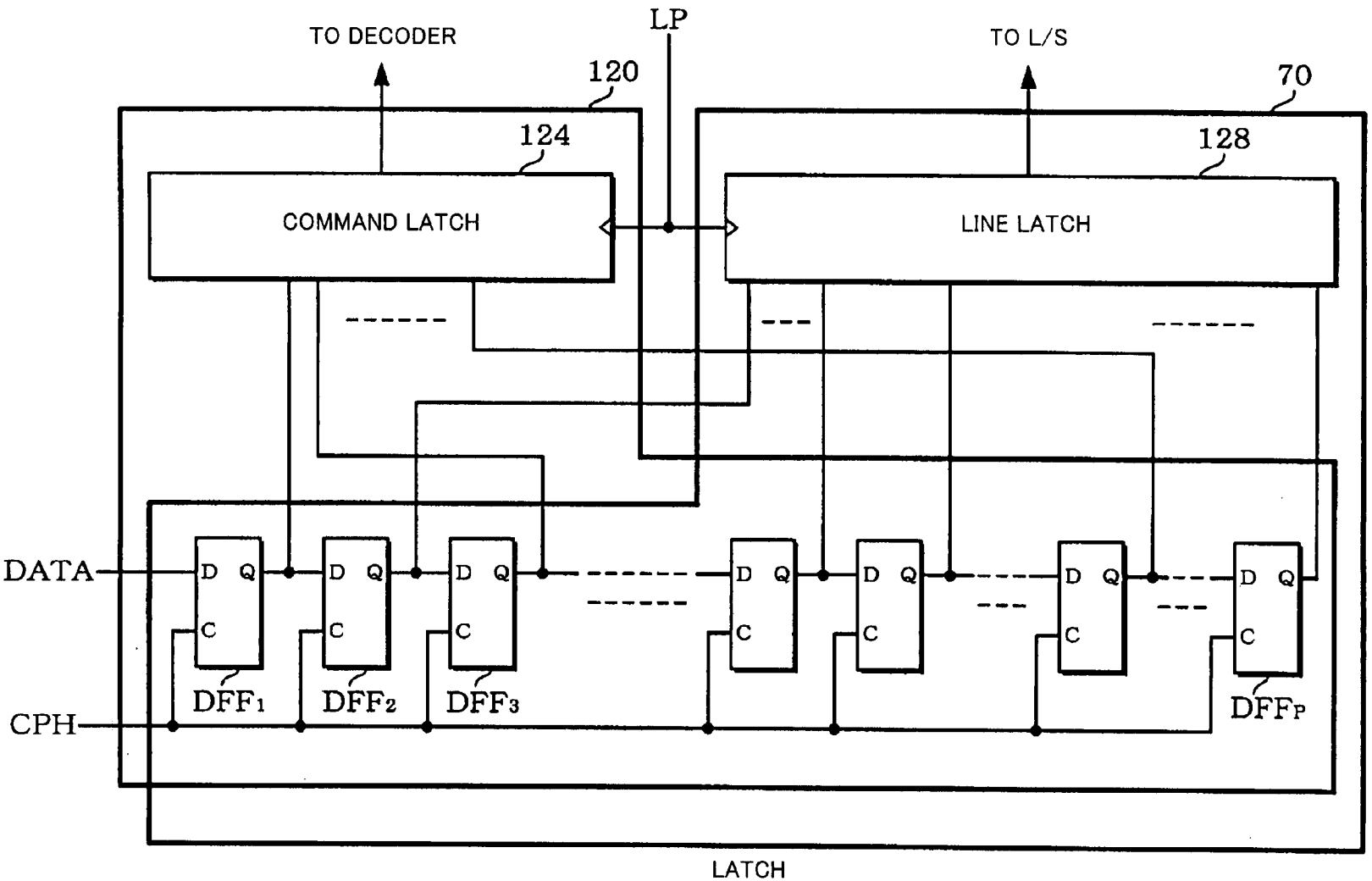
FIG. 10 is a block diagram of another example of the configuration of the latch and data latch of the second embodiment.

In FIG. 9, the shift register 122 of the latch 120 is differentiated from the shift register 126 of the data latch 70, but the configuration is not limited thereto. For example, the flip-flops of the shift register 122 and the shift register 126 could be used in common, as shown in FIG. 10, so that the outputs of the flip-flops that hold data at the previously determined word positions could be connected to either the command latch 124 or the line latch 128.

In other words, the configuration could be as described below. The latch 120 could include a shift register having first to P-th flip-flops (where P is an integer more than one) $DFF_1$ to $DFF_P$, where the flip-flops hold data in word units. In this shift register the output of the p-th flip-flop $DFF_p$ (where p is an integer such that $1 \leqq p \leqq P-1$) is connected to the input of the (p+1)th flip-flop $DFF_{p+1}$. The input data that is input to the first flip-flop $DFF_1$ in the shift register is shifted in synchronization with the shift clock CPH. The decoder 130 decodes the data that is held in the q-th flip-flop (where q is an integer such that $1 \leqq q \leqq P$) $DFF_q$ (any one of the first to P-th flip-flops $DFF_1$ to $DFF_P$), in synchronization with the rise of the latch pulse LP.

Thus the command data fetched into the latch 120 is decoded by the decoder 130. The decoder 130 first analyses the fetched command data to determine whether or not it is execution command data.

Figure 11:
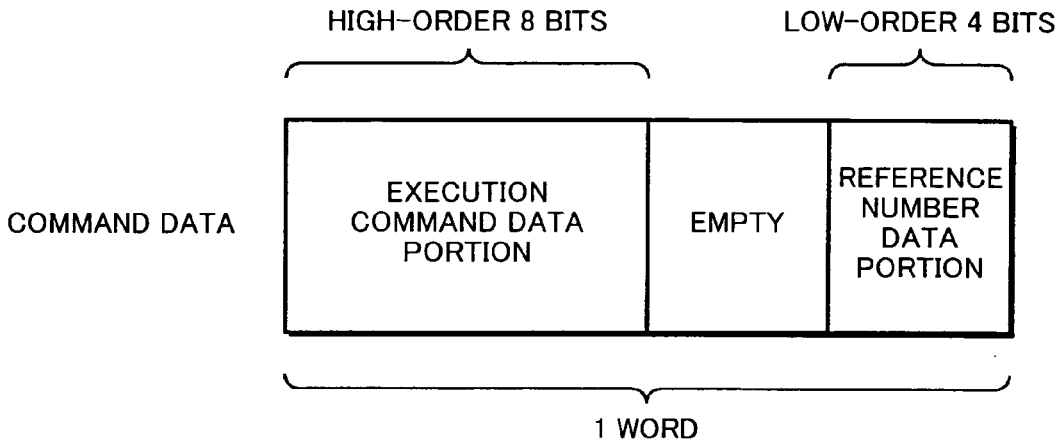
FIG. 11 is illustrative of an example of the configuration of command data in accordance with the second embodiment.

An example of the configuration of command data analyzed by the decoder 130 is shown in FIG. 11. The decoder 130 first analyzes command data such as that shown in FIG. 11. This command data has an execution command data portion in the high-order 8 bits and a reference number data portion in the low-order 4 bits.

If the data of the execution command data portion corresponds to a given execution command, the decoder 130 continues the decoding to determine whether or not the number of words indicated by the reference number data portion is an ordinary command.

Figure 12:
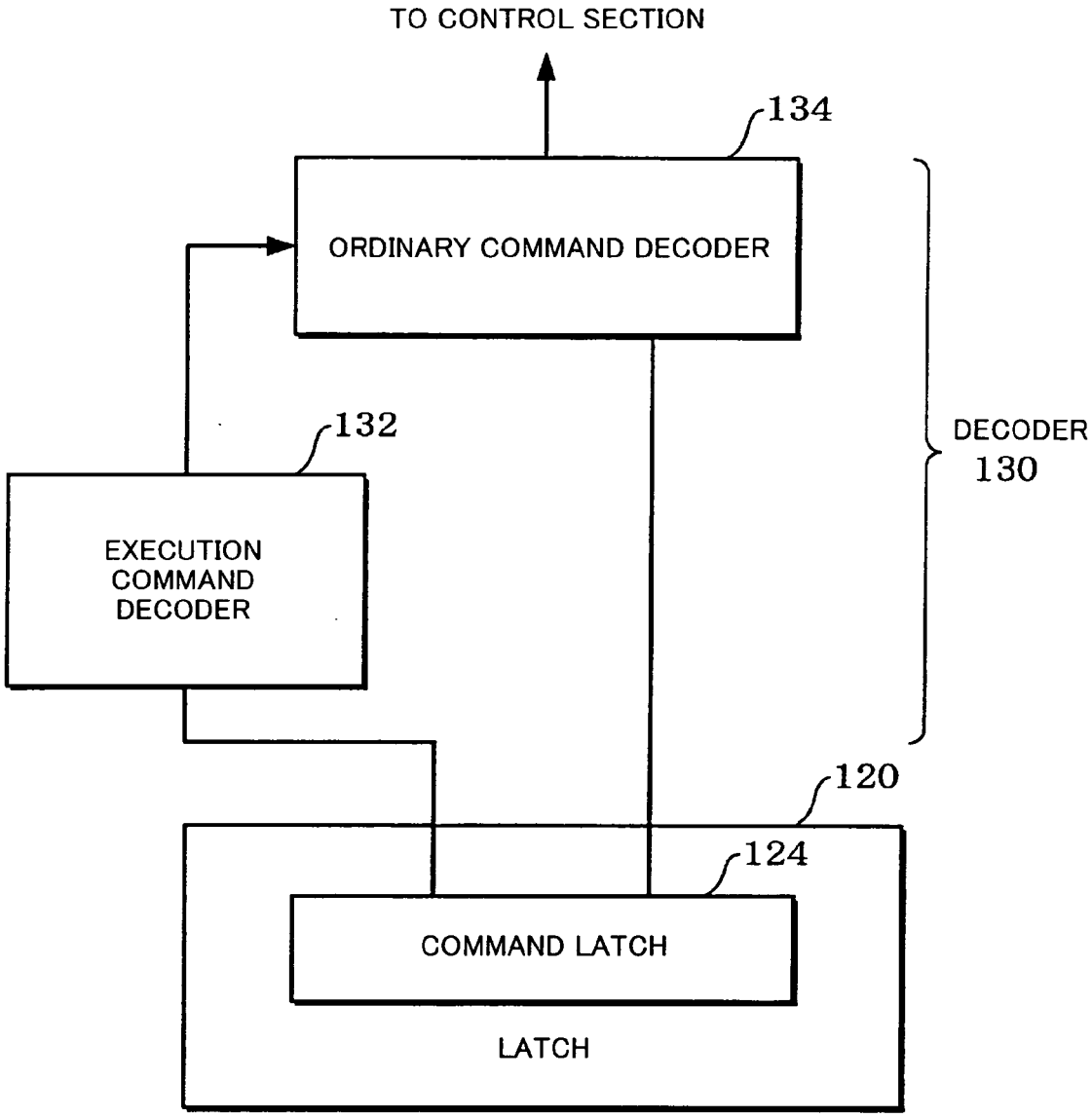
FIG. 12 is a block diagram of an example of the configuration of the decoder of the second embodiment.

An outline of the configuration of the decoder 130 is shown in FIG. 12. The decoder 130 include an execution command decoder 132 and an ordinary command decoder.

The execution command decoder 132 decodes the data of the execution command data portion, which is part of the data held in the command latch 124 (the data held in the q-th flip-flop $DFF_q$ of the shift register 122).

If it is determined that the data of the execution command data portion is a given execution command, based on the decoding result of the execution command decoder 132, the ordinary command decoder 134 extracts the number of words of command data indicated by the reference number data portion from the command latch 124 and decodes that command data. The number of words of command data indicated by the reference number data portion is data at word positions other than the word position of the word that includes the above-mentioned execution command data portion. More specifically, it is the data of a word held in at least one flip-flop of the first to P-th flip-flops, excluding the q-th flip-flop that holds the data of the word including the execution command data portion. Even more specifically, it is data held in at least one flip-flop that is specified by the reference number data portion of data held in the q-th flip-flop, from the first to P-th flip-flops (excluding the q-th flip-flop) that hold word data including an execution command data portion.

It is preferable that the command data that is at the word position of a word that includes the execution command data portion is the data held in the first flip-flop $DFF_1$ of the shift register 122 of FIG. 9 immediately before the latching into the command latch 124 in synchronization with the rise of the latch pulse LP. It is also preferable that the ordinary command data is the data held in one of the second to J-th flip-flops $DFF_2$ to $DFF_J$ of the shift register 122 of FIG. 9 immediately before the latching into the command latch 124 in synchronization with the rise of the latch pulse LP.

The decoding result of the ordinary command decoder 134 is output to the control section 80.

It is preferable that the thus-configured decoder 130 operates in synchronization with a clock of a frequency higher than that of the latch pulse LP, in a similar manner to the first embodiment. It is also preferable that this clock is the shift clock CPH.

Figure 13:
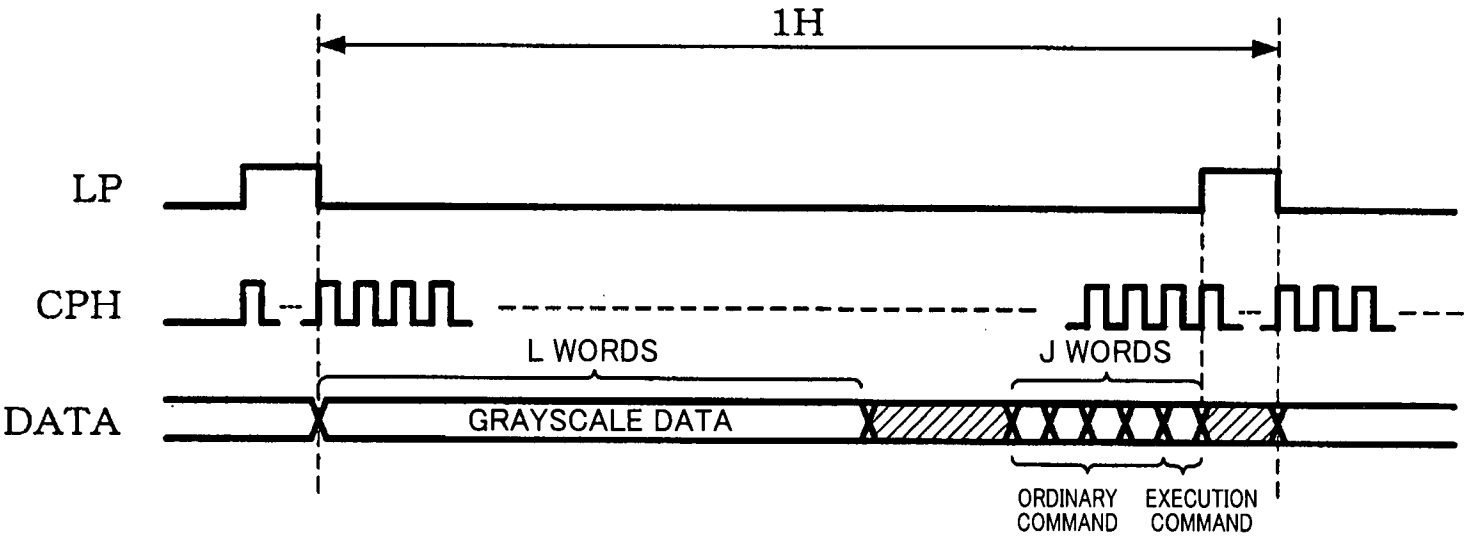
FIG. 13 is a timing chart of an example of the operation of the data line drive circuit of the second embodiment.

The control section 80 can perform control based on the control signal generated by the control section 80, in the next horizontal scan period after the horizontal scan period in which the data decoded by the decoder 130 was fetched, as shown in FIG. 6 An example of the operational timing of the data line drive circuit 110 of the second embodiment is shown in FIG. 13. In this case, the description of the data line drive circuit 110 refers to the configuration shown in FIG. 9.

Data that is display data (grayscale data) and command data which has been time-division multiplexed is input to the data line drive circuit 110 within one horizontal scan period (1H). In FIG. 13, L words of grayscale data and J words of command data, which includes command data having the execution command data portion shown in FIG. 11, are input within 1H.

The command latch 124 fetches the input data (command data) that was held in the shift register 122 previously, in synchronization with the rise of the latch pulse LP.

The decoder 130 extracts the previously determined word of command data from the command latch 124, analyzes the data equivalent to the execution command data portion, and determines whether or not it is an execution command.

If it is determined to be an execution command, the decoder 130 extracts command data at the word position specified by the reference number data portion, from the command latch 124. If the word position having the execution command data portion is the S-th word, by way of example, and if the reference number data portion indicates "3", it extracts command data at the (S-1)th, (S-2)th, and (S-3)th word positions. The decoding of the ordinary command is done with reference to the thus-extracted command data.

The result of decoding the ordinary command by the decoder 130 is output to the control section 80. The control section 80 outputs a control signal corresponding to this decoding result.

Note that the present invention is not limited to this embodiment and thus various modifications thereto are possible within the scope of the invention laid out herein.

Part of requirements of any claim of the present invention could be omitted from a dependent claim which depends on that claim. Moreover, part of requirements of any independent claim of the present invention could be made to depend on any other independent claim.

The above-described embodiments disclose the items listed below.

One embodiment of the present invention relates to a display driver for driving a display section based on display data, the display driver comprising:

a data input terminal for inputting data in which display data and command data is time-division multiplexed within one horizontal scan period;

a command identification signal input terminal for inputting a command identification signal for identifying command data;

a latch which fetches command data specified by the command identification signal;

a decoder which decodes command data fetched into the latch; and a control section which outputs a control signal corresponding to a decoding result of the decoder, wherein the display section is driven based on the control signal and display data included within the input data.

This embodiment uses a command identification signal to specify command data from input data that is display data and command data which has been multiplexed in a time-division manner, thus enabling control based on the thus-specified command data. It is therefore possible to perform display driver control by commands from a general-purpose controller, by outputting a command identification signal from a general purpose input/output (GPI/O) terminal that is a universal input-output terminal commonly used by controllers.

Moreover, the controller that controls the display driver can handle the command data in a manner similar to that of display data, simplifying the circuit used for controlling the display driver.

Another embodiment of the present invention relates to a display driver for driving a display section based on display data, the display driver comprising:

a latch which fetches input data in synchronization with a rise of a latch pulse, the input data being formed by time-division multiplexing display data and command data within one horizontal scan period, the command data being formed of a plurality of words and the horizontal scan period being specified by the period of the latch pulse;

a decoder which decodes command data positioned at a previously determined word position within the input data fetched into the latch; and a control section which outputs a control signal corresponding to a decoding result of the decoder, wherein the display section is driven based on the control signal and display data included within the input data.

This embodiment makes it possible to control the display driver by command data, without using a command identification signal. This therefore enables control by display driver commands, even with a more general type of controller.

With a display driver in accordance with this embodiment, the latch may include a shift register having first to P-th flip-flops (where P is an integer more than one), the flip-flops holding data in word units; an output of the p-th flip-flop (where p is an integer such that $1 \leqq p \leqq P-1$) may be connected to an input of the (p+1)th flip-flop, and the shift register shifts the input data in synchronization with a given shift clock, the input data that has been input to the first flip-flop; and the decoder may decode the data that is held in the q-th flip-flop (where q is an integer such that $1 \leqq q \leqq P$) as the command data positioned at the previously determined word position, in synchronization with the rise of the latch pulse.

In the display driver in accordance with this embodiment, the decoder may include an execution command decoder which decodes data in an execution command data portion which is a part of the data held in the q-th flip-flop; and an ordinary command decoder which decodes data held in at least one flip-flop of the first to P-th flip-flops, excluding the q-th flip-flop, when the data of the execution command data portion has been determined to be a given execution command, based on a decoding result of the execution command decoder, and the control section may output a control signal corresponding to a decoding result of the ordinary command decoder The configuration of flip-flops of the shift register of this display driver enables simple specification of command data that has been multiplexed in a time-division manner with display data, thus simplifying control by commands and also enabling a simplification of the circuit.

With the display driver in accordance with this embodiment, the ordinary command decoder may decode data that is held in at least one of flip-flops for a number of words among the first to P-th flip-flops excluding the q-th flip-flop, the number of words being specified by data of a reference number data portion of data held in the q-th flip-flop, when the data of the command data portion has been determined to be a given execution command, based on the decoding result of the execution command decoder, Such a display driver makes it possible to increase the number of ordinary commands to be decoded by the execution command data, it enables complicated display driver control with an extremely simple configuration.

In the display driver in accordance with this embodiment, the decoder may operate in synchronization with a clock of a frequency higher than a frequency of the latch pulse.

This display driver outputs the decoding result within the horizontal scan period in which the command data has been fetched, and also facilitates the generation of a control signal corresponding to that decoding result before the next horizontal scan period.

In the display driver in accordance with this embodiment, the clock of a frequency higher than the frequency of the latch pulse may be the shift clock.

This display driver makes it possible to utilize existing signals in the display driver, without having to generate a new clock, thus enabling a simplification of the circuit.

In the display driver in accordance with the above embodiment, the control section may perform control based on the control signal in a next horizontal scan period following the horizontal scan period in which the data to be decoded by the decoder has been fetched.

This display driver makes it possible to avoid the danger or delays in the display driver control, enabling a simplification in the display driver control.

A further embodiment of the present invention relates to a electro-optical device comprising:

a display panel having a plurality of data lines, a plurality of scan lines, and a plurality of pixels, each of the pixels being specified by one of the data lines and one of the scan lines; and any one of the display drivers described above which drives the data lines of the display panel.

A still further embodiment of the present invention relates to an electro-optical device comprising:

a plurality of data lines;

a plurality of scan lines;

a plurality of pixels, each of the pixels being specified by one of the data lines and one of the scan lines; and any one of the display drivers described above which drives the data lines.

Each of these embodiments makes it possible to provide an electro-optical device that can be controlled by commands from a general-purpose controller.

A yet further embodiment of the present invention relates to a method of controlling a display driver for driving a display section based on display data, the method comprising:

fetching command data specified by a command identification signal for identifying command data from input data in which display data and command data is time-division multiplexed within one horizontal scan period;

decoding the fetched command data;

generating a control signal corresponding to a decoding result of the command data; and driving the display section, based on the control signal and display data included within the input data.

An even further embodiment of the present invention relates to a method of controlling a display driver for driving a display section based on display data, the method comprising:

fetching input data in synchronization with a rise of a latch pulse, the input data being formed by time-division multiplexing display data and command data within one horizontal scan period, the command data being formed of a plurality of words and the horizontal scan period being specified by the period of the latch pulse;

decoding command data positioned at a previously determined word position within the fetched input data;

generating a control signal corresponding to a decoding result of the command data; and driving the display section, based on the control signal and display data included within the input data.

The method of controlling a display driver in accordance with this embodiment may further comprise:

decoding data of an execution command data portion that is a part of the command data positioned at a previously determined word position within the input data;

decoding command data positioned at another word position of the input data fetched in synchronization with a rise of the latch pulse, when it has been determined that data of the execution command data portion is a given execution command based on a decoding result of the data;

generating a control signal corresponding to a decoding result of the command data at the other word position; and driving the display section, based on the control signal and display data included within the input data.

The method of controlling a display driver in accordance with this embodiment may further comprise:

decoding command data positioned at a word position based on data of a reference number data portion within data of the execution command data portion, when it has been determined that the data is a given execution command based on the decoding result of the data;

generating a control signal corresponding to the decoding result of the command data positioned at the word position, based on the data of the reference number data portion; and driving the display section, based on the control signal and display data included within the input data.

What is claimed is:

1. A display driver for driving a display section based on display data, the display driver comprising:

a data input terminal for inputting data in which display data and command data is time-division multiplexed within one horizontal scan period;

a command identification signal input terminal for inputting a command identification signal for identifying command data;

a latch which fetches command data specified by the command identification signal;

a decoder which decodes command data fetched into the latch; and a control section which outputs a control signal corresponding to a decoding result of the decoder, wherein the display section is driven based on the control signal and display data included within the input data.

2. The display driver as defined by claim 1, wherein the control section performs control based on the control signal in a next horizontal scan period following the horizontal scan period in which the data to be decoded by the decoder has been fetched.

3. An electro-optical device comprising:

a display panel having a plurality of data lines, a plurality of scan lines, and a plurality of pixels, each of the pixels being specified by one of the data lines and one of the scan lines; and the display driver as defined by claim 1 which drives the data lines of the display panel.

4. An electro-optical device comprising:

a plurality of data lines;

a plurality of scan lines;

a plurality of pixels, each of the pixels being specified by one of the data lines and one of the scan lines; and the display driver as defined by claim 1 which drives the data lines.

5. A display driver for driving a display section based on display data, the display driver comprising:

a latch which fetches input data in synchronization with a rise of a latch pulse, the input data being formed by time-division multiplexing display data and command data within one horizontal scan period, the command data being formed of a plurality of words and the horizontal scan period being specified by the period of the latch pulse;

a decoder which decodes command data positioned at a previously determined word position within the input data fetched into the latch; and a control section which outputs a control signal corresponding to a decoding result of the decoder, wherein the display section is driven based on the control signal and display data included within the input data.

6. The display driver as defined by claim 5, wherein the latch comprises a shift register having first to P-th flip-flops (where P is an integer more than one), the flip-flops holding data in word units, wherein an output of the p-th flip-flop (where p is an integer such that $1 \leqq p \leqq P-1$) is connected to an input of the (p+1)th flip-flop, and the shift register shifts the input data in synchronization with a given shift clock, the input data that has been input to the first flip-flop, and wherein the decoder decodes the data that is held in the q-th flip-flop (where q is an integer such that $1 \leqq q \leqq P$) as the command data positioned at the previously determined word position, in synchronization with the rise of the latch pulse.

7. The display driver as defined by claim 6, wherein the decoder comprises:

an execution command decoder which decodes data in an execution command data portion which is a part of the data held in the q-th flip-flop; and an ordinary command decoder which decodes data held in at least one flip-flop of the first to P-th flip-flops, excluding the q-th flip-flop, when the data of the execution command data portion has been determined to be a given execution command, based on a decoding result of the execution command decoder, and wherein the control section outputs a control signal corresponding to a decoding result of the ordinary command decoder.

8. The display driver as defined by claim 7, wherein the ordinary command decoder decodes data that is held in at least one of flip-flops for a number of words among the first to P-th flip-flops excluding the q-th flip-flop, the number of words being specified by data of a reference number data portion of data held in the q-th flip-flop, when the data of the command data portion has been determined to be a given execution command, based on the decoding result of the execution command decoder.

9. The display driver as defined by claim 6, wherein the decoder operates in synchronization with a clock of a frequency higher than a frequency of the latch pulse.

10. The display driver as defined by claim 9, wherein the clock of a frequency higher than the frequency of the latch pulse is the shift clock.

11. The display driver as defined by claim 5, wherein the control section performs control based on the control signal in a next horizontal scan period following the horizontal scan period in which the data to be decoded by the decoder has been fetched.

12. An electro-optical device comprising:

a display panel having a plurality of data lines, a plurality of scan lines, and a plurality of pixels, each of the pixels being specified by one of the data lines and one of the scan lines; and the display driver as defined by claim 5 which drives the data lines of the display panel.

13. An electro-optical device comprising:

a plurality of data lines;

a plurality of scan lines;

a plurality of pixels such that each pixel is specified by one of the data lines and one of the scan lines; and the display driver as defined by claim 5 which drives the data lines.

14. A method of controlling a display driver for driving a display section based on display data, the method comprising:

fetching command data specified by a command identification signal for identifying command data from input data in which display data and command data is time-division multiplexed within one horizontal scan period;

decoding the fetched command data;

generating a control signal corresponding to a decoding result of the command data; and driving the display section, based on the control signal and display data included within the input data.

15. A method of controlling a display driver for driving a display section based on display data, the method comprising:

fetching input data in synchronization with a rise of a latch pulse, the input data being formed by time-division multiplexing display data and command data within one horizontal scan period, the command data being formed of a plurality of words and the horizontal scan period being specified by the period of the latch pulse;

decoding command data positioned at a previously determined word position within the fetched input data;

generating a control signal corresponding to a decoding result of the command data; and driving the display section, based on the control signal and display data included within the input data.

16. The method of controlling a display driver as defined by claim 15, further comprising:

decoding data of an execution command data portion that is a part of the command data positioned at a previously determined word position within the input data;

decoding command data positioned at another word position of the input data fetched in synchronization with a rise of the latch pulse, when it has been determined that data of the execution command data portion is a given execution command based on a decoding result of the data;

generating a control signal corresponding to a decoding result of the command data at the other word position; and driving the display section, based on the control signal and display data included within the input data.

17. The method of controlling a display driver as defined by claim 16, further comprising:

decoding command data positioned at a word position based on data of a reference number data portion within data of the execution command data portion, when it has been determined that the data is a given execution command based on the decoding result of the data;

generating a control signal corresponding to the decoding result of the command data positioned at the word position, based on the data of the reference number data portion; and driving the display section, based on the control signal and display data included within the input data.

* * * * *